US011434860B2

(12) United States Patent
Nicolai et al.

(10) Patent No.: US 11,434,860 B2
(45) Date of Patent: Sep. 6, 2022

(54) FUEL DISTRIBUTOR AND PRESSURE ACCUMULATOR RAIL

(71) Applicant: Benteler Automobiltechnik GmbH, Paderborn (DE)

(72) Inventors: Jan-Philipp Nicolai, Paderborn (DE); Ralf Thiele, Marsberg (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 34 days.

(21) Appl. No.: 17/010,956

(22) Filed: Sep. 3, 2020

(65) Prior Publication Data

US 2021/0062773 A1 Mar. 4, 2021

(30) Foreign Application Priority Data

Sep. 4, 2019 (DE) ..... 102019123673.8

(51) Int. Cl.

*F02M 69/46* (2006.01)
*F02M 63/02* (2006.01)
*F02M 55/02* (2006.01)

(52) U.S. Cl.

CPC ..... *F02M 63/0275* (2013.01); *F02M 55/025* (2013.01); *F02M 2200/855* (2013.01); *F02M 2200/857* (2013.01)

(58) Field of Classification Search

CPC ..... F02M 55/025; F02M 63/0275; F02M 2200/855; F02M 2200/857

See application file for complete search history.

(56) References Cited

U.S. PATENT DOCUMENTS 6,341,595 B1 * 1/2002 Scollard ..... F02M 55/004 123/456
9,453,485 B2 * 9/2016 Masti ..... F16L 3/00
9,683,532 B2 * 6/2017 Rehwald ..... F16L 55/035

(Continued)

FOREIGN PATENT DOCUMENTS

DE 102013217810 A1 3/2015
EP 3196457 A1 7/2017

OTHER PUBLICATIONS

Office Action for German Application No. 10 2019 123 673.8 datd May 15, 2020; 13pp.

(Continued)

*Primary Examiner* — Gonzalo Laguarda
(74) *Attorney, Agent, or Firm* — Hauptman Ham, LLP

(57) ABSTRACT

A fuel distributor which has a pressure accumulator rail for receiving pressurized fuel. The pressure accumulator rail has a forged base body. Mounting supports are joined to the base body by substance bonding. A mounting support is formed by two metal brackets each configured as a sheet-metal formed part. Each metal bracket has a holding portion adapted to the outer contour of the base body, a leg angled relative to the holding portion, and a mounting flange on the free end of the leg and angled away therefrom. A length portion of the base body is received between the holding portions. The holding portions partially surround the base body. The base body and the holding portions are joined by substance bonding. The legs of the two metal brackets lie next to each other at least in regions and are also joined together by substance bonding.

15 Claims, 6 Drawing Sheets

(56) References Cited

U.S. PATENT DOCUMENTS

| | | | | |
|---|---|---|---|---|
| 2007/0163545 | A1* | 7/2007 | Beardmore | F02M 55/025 123/456 |
| 2008/0156299 | A1* | 7/2008 | Sebastian | F02M 69/465 123/470 |
| 2016/0305387 | A1 | 10/2016 | Haug et al. | |
| 2017/0260945 | A1 | 9/2017 | Soma et al. | |

OTHER PUBLICATIONS

Search Report for European Application No. 20184705.0 dated Nov. 27, 2020; 10pp.

* cited by examiner

FUEL DISTRIBUTOR AND PRESSURE ACCUMULATOR RAIL

RELATED APPLICATIONS

The present application claims priority of German Application Number 10 2019 123 673.8 filed Sep. 4, 2019, the disclosure of which is hereby incorporated by reference herein in its entirety.

FIELD

The disclosure concerns a fuel distributor.

A fuel distributor is part of a fuel supply or fuel injection system and serves to supply fuel to the injectors of an internal combustion engine. Statically compressed fuel is stored in a pressure accumulator rail and distributed to the injectors or injector valves of a cylinder bank.

BACKGROUND

In fuel distributors with forged pressure accumulator rails, the base body of the pressure accumulator rail is normally machined by drilling and turning or milling. The longitudinal bore is normally produced by deep hole drilling. Connectors or injector receivers and mounting elements, or mounting supports between the pressure accumulator rail and the cylinder block, are often formed by forging or produced integrally from the material of the base body.

EP 2 998 566 A1 discloses a fuel distributor according to the prior art with a forged base body and mounting supports. The mounting supports are formed by flange portions which are formed integrally from the material of the base body, and sleeves which are pressed into bores in the flange portions.

EP 3 165 760 A1 discloses a fuel distributor in which the pressure accumulator rail has a forged base body, on which stub-like injector receivers and mounting supports are formed integrally from the same material. The pressure accumulator rail is attached to the cylinder head of an internal combustion engine via the mounting supports by means of fixing bolts. On their end on the cylinder-head side, the mounting supports each have a flange portion with a hole for passage of the fixing bolt. To produce the mounting supports, these are machined by material removal in a relatively costly process.

DE 10 2010 014 497 A1 describes a fuel distribution device for a motor vehicle with a pressure accumulator rail and with at least one holding part which at least partially surrounds the fuel rail. The holding part is a sheet-metal formed part which constitutes a U-shaped bracket. By means of the holding part, the pressure accumulator rail can be fixed to the cylinder head by fixing bolts which are passed through openings or pockets formed on the sheet-metal part, and bolted to the cylinder head.

Starting from the prior art, the disclosure is based on the object of creating a fuel distributor with a forged base body with injector receivers and mounting supports, which has reduced weight and requires less machining with material removal.

SUMMARY

This object is achieved according to the disclosure by a fuel distributor.

A fuel distributor is proposed which has a pressure accumulator rail for receiving pressurized fuel. The pressure accumulator rail has a forged base body on which integral injector receivers are formed from the same material in a forging process. The injector receivers serve for connection to the fuel injectors of an internal combustion engine. Furthermore, mounting supports are provided which are joined to the base body by substance bonding. The mounting supports form fixing elements between the pressure accumulator rail and a further motor vehicle component, for example, the cylinder block.

The pressure accumulator rail is forged from a blank. The material is a stainless steel alloy. Stainless steel alloys of material type 1.4307 or 1.4301 are suitable.

The pressure accumulator rail of the fuel distributor has a forged tubular base body. In the context of the disclosure, a tubular base body means an elongate hollow body which however is not restricted to a round or circular cross-section either with respect to the interior or with respect to the outer periphery. A round inner cross-section may be used insofar as the interior is usually produced by deep hole drilling or blind hole boring.

The injector receivers are formed onto the base body in the forging process. Furthermore, an integral connector for the fuel inlet and a stub-like receiver for mounting a pressure sensor may be formed on the pressure accumulator rail of the fuel distributor from the same material.

The mounting supports are produced separately by sheet-metal forming and are joined to the base body of the pressure accumulator rail.

According to the disclosure, a mounting support is formed by two metal brackets, each configured as a sheet-metal formed part. Each metal bracket has a holding portion adapted to the outer contour of the base body, a leg angled relative to the holding portion, and a mounting flange at the free end of the leg and angled away therefrom. A length portion of the base body is received between the holding portions. The holding portions partially surround the base body. The base body and holding portions are joined by substance bonding. The legs of the two metal brackets lie next to each other at least in regions and are also joined together by substance bonding.

The holding portions receive the pressure accumulator rail and serve to hold and secure the base body of the pressure accumulator rail. The legs bridge the distance between the pressure accumulator rail and the mounting points. The mounting flanges serve to fix the fuel distributor to the mounting points in the engine bay.

The mounting support is configured as a sheet-metal formed part. The mounting support has a pair of metal brackets. The two metal brackets are arranged symmetrically, i.e. in the same but mirror-image fashion on both sides relative to the central longitudinal plane of the pressure rail, one on the left and one on the right of the pressure rail. The holding portions of the metal brackets are designed to hold the pressure accumulator rail. The legs of the two metal brackets are in contact with each other at least in regions, and bridge the distance between the pressure accumulator rail and the mounting point in the engine bay, i.e. a cylinder block. The mounting flanges are angled away from the legs at right angles and serve for fixing the pressure accumulator rail to the mounting point. Mounting takes place via screw bolts. Accordingly, mounting openings are provided in the mounting flanges, through which a fixing bolt can be guided.

Only little machining with material removal is required on the forged pressure accumulator rail. The base body with formed injector receivers is produced by forging.

The mounting supports have a pair of metal brackets. The metal brackets are made from a metal plate with a sheet thickness of 3 mm to 5 mm. For this, firstly flat plate blanks are cut from a steel sheet as identical components. The plate blanks are provided with the necessary mounting openings and cutouts. The plate portions may be perforated in a punching step at the same time as production of the plate blanks. They are punched in a progressive process. This allows for calibration of components. The plate blanks are then formed into individual metal brackets. This takes place by bending and edging processes.

The holding portions are joined to the base body by substance bonding. This takes place by soldering. The legs of the metal brackets are also joined together by substance bonding. This also takes place by soldering. The soldering process takes place in a through-flow furnace. Before the soldering process, the holding portions of the metal brackets may be pre-fixed to the base body of the pressure accumulator rail, and the legs may be pre-fixed together, for example by tack welding. To solder the base body and holding portions, solder or solder paste is applied above the base body. Solder or solder paste is also applied to a suitable point for soldering the legs together. During the soldering process, the solder is distributed between the base body and metal brackets under gravity and capillary forces.

The furnace soldering process brings the positive effect that the pressure accumulator rail is soft-annealed. A temperature range in the soldering process from 850° C. to 1100° C. leads to a recrystalline material structure of the base body material. As a result of the recrystalline material structure, the material wear is lower during material removal machining, for example deep hole drilling.

The furnace soldering process and associated heat treatment are followed by a cooling process. Rapid cooling takes place with a cooling rate greater than or equal to (≥) 45° C./min. In this way, direct corrosion protection is achieved since no chromium carbide forms during this cooling process, and hence sufficient chromium remains for passivating the surface. A subsequent pickling and passivating process may be omitted. The corrosion resistance is increased. As already stated, the machining properties of the forged base body for mechanical machining steps are also improved.

A holding portion surrounds the base body in cross-section over a peripheral region, namely over an angle of between 90° and 180°. The peripheral region extends over an angle of between 100° and 160°. A further peripheral region extends over an angle of between 110° and 140°. At least one embodiment of the disclosure provides that the peripheral region extends over an angle of 130°±5°.

The peripheral region is an arcuate portion in which the holding portion and the base body are in mutual contact.

The legs are arranged below the base body in the central longitudinal plane of the pressure accumulator rail, and extend substantially rectilinearly.

Another exemplary embodiment provides that a metal bracket has a cutout, for example, in the form of a slot, oriented in its longitudinal direction. The cutout is arranged and configured so as to create a tool clearance, which improves or facilitates the accessibility of the fixing bolts for mounting the pressure accumulator rail. Since the mounting points lie below the base body and are partially covered by the base body itself, the accessibility of the mounting point is obstructed. The cutouts serving as tool clearance improve accessibility and mounting.

For the actual mounting, a mounting opening is provided in each mounting flange of the metal bracket. A fixing bolt can be guided through this opening and tightened in a threaded bore.

Another exemplary embodiment provides that the leg of a metal bracket tapers, starting from the transition to the holding portion, in the direction towards the mounting flange. In side view, this gives a V-shaped design of the leg. The design of the leg may also be triangular or trapezoid.

A holding portion has a length, measured in the longitudinal direction of the base body, which is greater than the cross-section of the base body. In principle, the holding portions of the metal brackets in the region surrounding the base body, in the axial direction or longitudinal direction of the base body, may be as wide as the installation space between the injector receivers and/or a pressure sensor connection allows. This relatively wide design counters any deformation of the pressure accumulator rail during operation.

A mounting support is arranged between each two injector receivers. The mounting supports are arranged on the respective tube ends of the base body.

The holding portion may have a length, measured in the longitudinal direction of the base body, which is dimensioned such that the holding portion covers at least 50% of the distance between the injector receivers.

A fundamental aspect of the disclosure provides that the metal brackets are designed as identical parts. The metal brackets may be arranged on one long side or the other long side. When the mounting support is formed from a pair of metal brackets, the metal brackets are arranged in the same but mirror-image fashion on both long sides of the base body.

Another exemplary embodiment furthermore provides that the metal brackets have an S-shaped contour in the vertical cross-section. This is designed such that the metal brackets have a holding portion with an arcuate curve. The curved form of the holding portions is adapted to or complementary to the outer contour of the base body, at least in the peripheral region coming into contact with the base body of the pressure accumulator rail. A leg running linearly downward relative to the base body adjoins the holding portion of a metal bracket. A mounting flange which is bent outward at right angles adjoins the free end of the leg facing away from the base body of the pressure accumulator rail. The transitions from the holding portion to the leg and from the leg to the mounting flange are rounded with radii.

The two metal brackets of a mounting support may lie directly diametrically opposite each other. The two metal brackets may however also be arranged axially offset to each other. The two metal brackets are arranged axially offset to each other in the longitudinal direction on opposing sides of the base body. The legs of the two metal brackets overlap in regions and lie next to each other in the overlap region. The legs are joined together by substance bonding, namely soldered, in the overlap region.

The disclosure creates a fuel distributor of reduced weight, with a forged base body and mounting supports joined by substance bonding, e.g., soldered. Configuring the mounting supports as sheet-metal formed parts reduces the need for material-removal machining processes on the forged base body. The furnace soldering process for joining and the associated heat treatment improve or facilitate subsequent material-removal machining processes and reduce tool wear. Furthermore, because of the heat treatment in the furnace soldering process and the resulting recrystallized material structure, no pickling and passivation step is required for corrosion protection.

The metal brackets configured as a sheet-metal formed part and the mounting supports made therefrom lead to weight optimization. The fuel distributor is light-weight and has a high mechanical strength. The substance-bonded joint between the base body and metal brackets has a high strength. The metal brackets, which are additionally soldered together in the region of the leg, guarantee a high strength at the bolting or mounting points.

BRIEF DESCRIPTION OF THE DRAWINGS

The disclosure is described in more detail below with reference to an exemplary embodiment. The drawings show.

In the figures, the same reference signs are used for identical or equivalent components, even if and when a repeat description is dispensed with for reasons of simplification.

DETAILED DESCRIPTION

Figure 1:
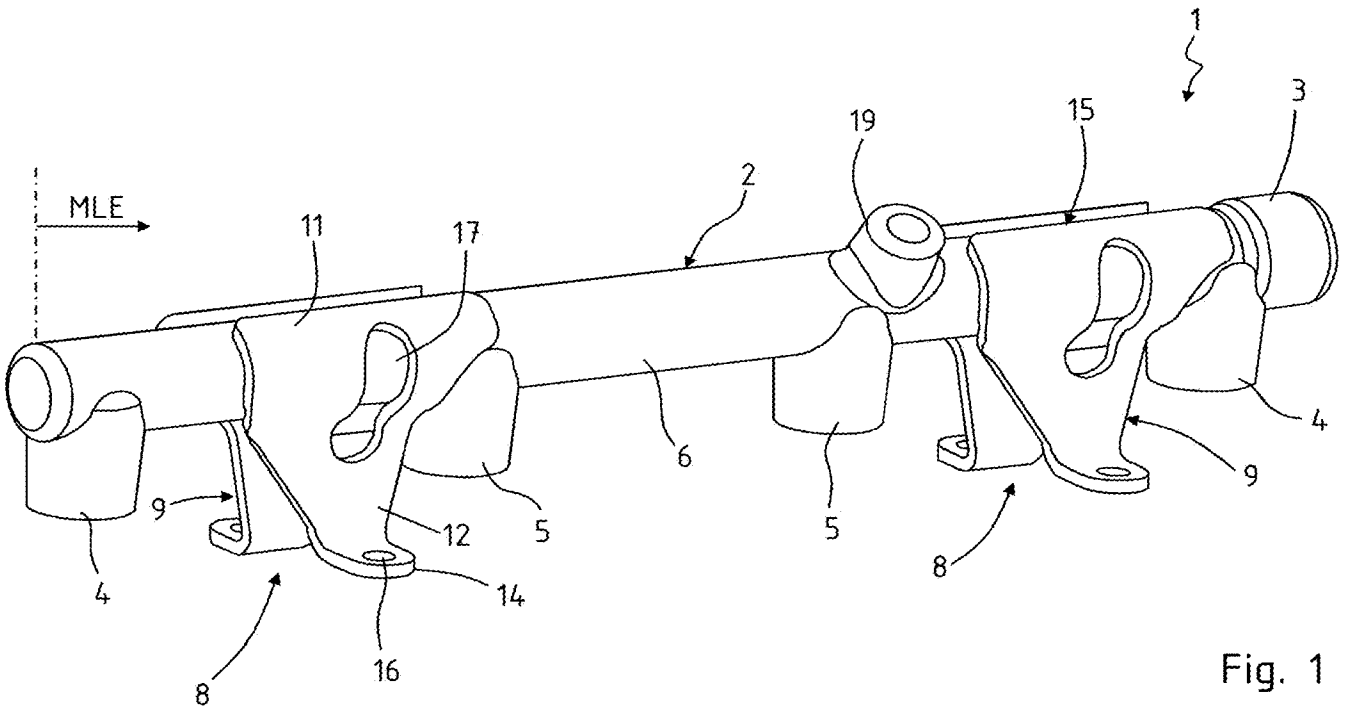
FIG. 1 shows a fuel distributor according to the disclosure in a perspective view.
Figure 2:
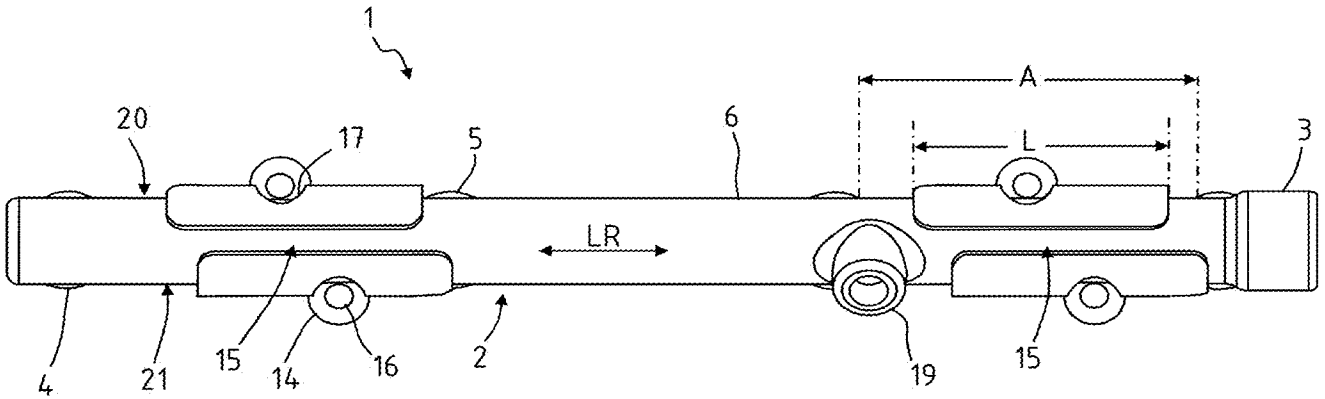
FIG. 2 shows a fuel distributor in a top view.
Figure 3:
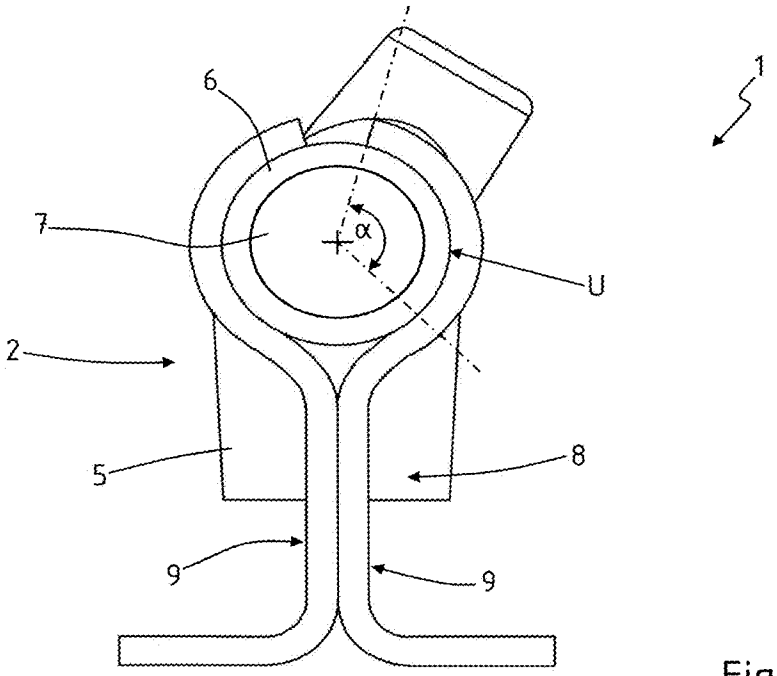
FIG. 3 is a vertical cross-section through the fuel distributor in the region of a mounting support.
Figure 4:
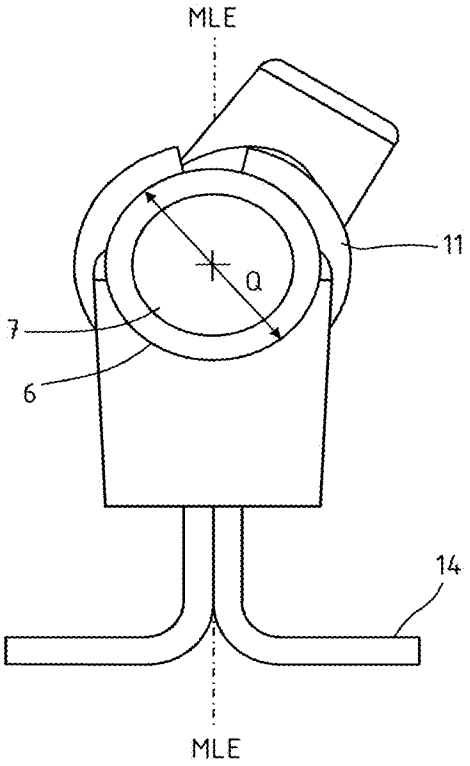
FIG. 4 is an end view of the fuel distributor.

FIGS. 1 to 4 show a fuel distributor 1. The fuel distributor 1 belongs to the accumulator injection system of an internal combustion engine. Pressure generation and fuel injection are decoupled from each other in such accumulator injection systems. A separate high-pressure pump continuously generates pressure. This pressure, built up independently of the injection sequence, is permanently available in the fuel distributor 1.

The fuel distributor 1 has a pressure accumulator rail 2 with a pump-side fuel inlet 3 and several stub-like injector receivers 4, 5. The statically compressed fuel is stored in the pressure accumulator rail 2 and made available to the injectors of a cylinder bank via the injector receivers 4, 5.

The pressure accumulator rail 2 has a forged tubular base body 6.

In the forging process, the stub-like injector receivers 4, 5 are formed integrally on the base body 6 from the same material. The stub-like fuel inlet 3 is also formed integrally on the base body 6 from the same material by forging. A longitudinal cavity 7 is made in the base body 6 by deep drilling.

To fix or mount the fuel distributor 1 on a cylinder head of a motor vehicle, mounting supports 8 are provided.

Figure 5:
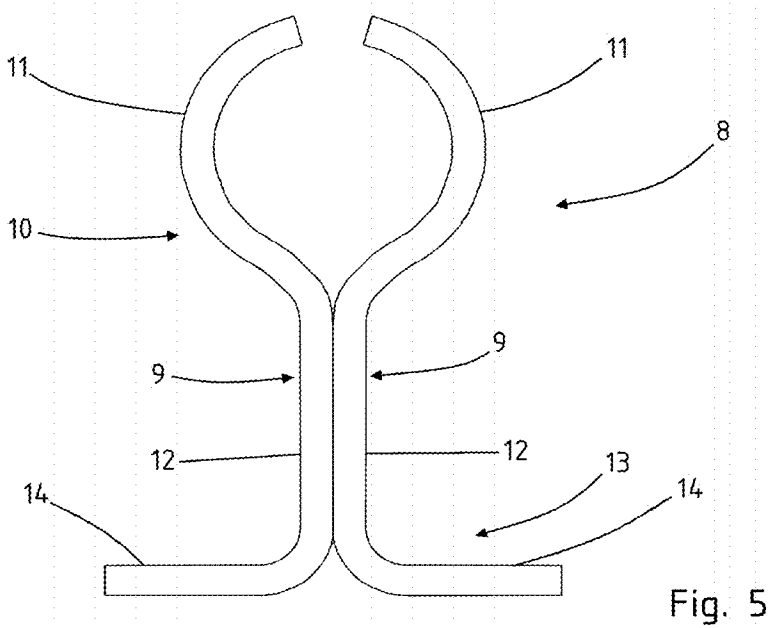
FIG. 5 shows a mounting support formed from two metal brackets in an end view.
Figure 8:
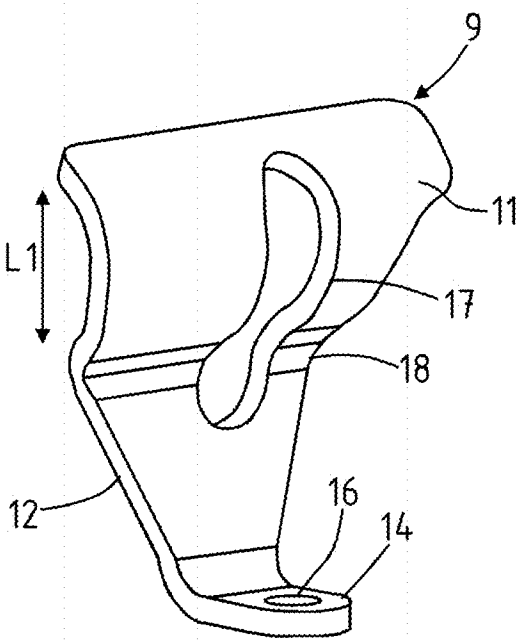
FIG. 8 shows the metal bracket in perspective.
Figure 7:
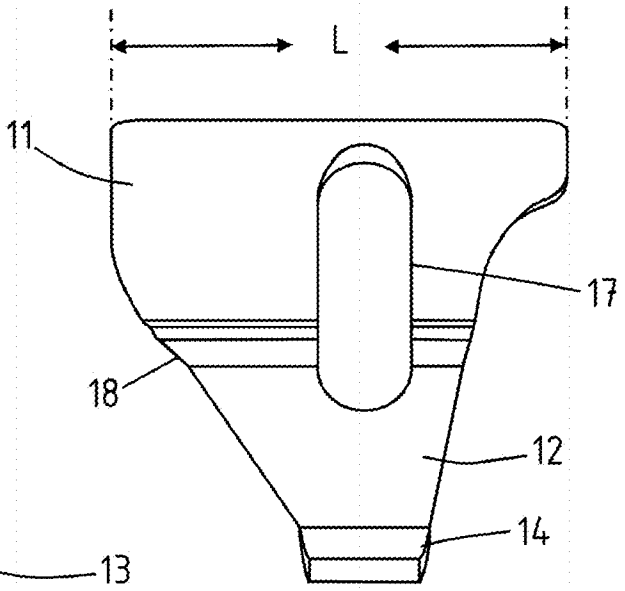
FIG. 7 shows the metal bracket illustrated in FIG. 6 in a side view.
Figure 6:
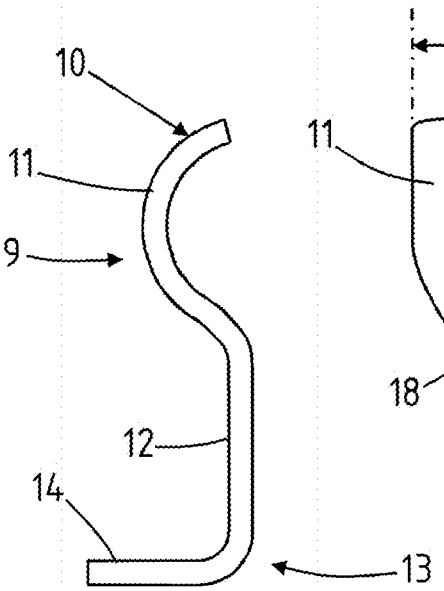
FIG. 6 shows a metal bracket in an end view.

A mounting support 8 is formed from two metal brackets 9 configured as sheet-metal formed parts (see also FIGS. 5 to 8). The two metal brackets 9 are assigned to each other in pairs. The metal brackets 9 have sheet steel and have a wall thickness from 3 mm to 5 mm.

On its upper end 10 on the base body side, a metal bracket 9 has a holding portion 11 adapted to the outer contour of the base body 6. A leg 12, which is angled relative to the holding portion 11, adjoins the holding portion 11. At the free end 13, i.e. the lower end of the leg 12 facing away from the base body 6, a mounting flange 14 is provided which is angled outward from the leg 12. A length portion 15 of the base body 6 is received between the holding portions 11 of the mounting support 8. The holding portions 11 partially surround the base body 6. The base body 6 and the holding portions 11 are joined by substance bonding, namely soldered. The legs 12 of the two metal brackets 9 overlap in regions and lie next to each other with mutual contact. In this contact region, the adjacent legs 12 are joined by substance bonding. This also takes place by soldering.

The metal brackets 9 are designed as identical parts. In vertical cross-section, the metal brackets have an S-shaped contour as described above.

A holding portion 11 surrounds the base body 6 in cross-section over a peripheral region U which, in the exemplary embodiment depicted here, extends over an angle $\alpha$ of 130°±5°. In principle, the peripheral region U may extend over an angle $\alpha$ of between 90° to 180°, or between 100° to 160°, or between 110° to 140°.

The peripheral region U is an arcuate portion in which the holding portion 11 and the base body 6 make mutual contact.

The two legs 12 of the metal bracket 9 or mounting support 8 are arranged below the base body 6 relative to the central longitudinal plane MLE, and extend linearly downward away from the base body 6 as far as the mounting flanges 14 which are bent outward at right angles. A mounting opening 16 is provided in each mounting flange 14 for passage of a fixing bolt. The mounting points are below the base body 6 and are partly covered by the base body 6 or holding portion 11 of the metal bracket 9 (see FIG. 2). To create a tool clearance and facilitate mounting of a fixing bolt, a cutout 17 oriented in the longitudinal direction L1 is provided in each metal bracket 9. The cutout 17 is formed as a slot and extends downward away from the holding portion 11 into the upper region of a leg 12. The cutout 17 functioning as tool clearance improves accessibility to the mounting point and fixing bolts, and facilitates the actual mounting process.

The legs 12 of the metal bracket 9 taper, starting from the transition 18 to the holding portion 11, in the direction towards the mounting flange 14. In side view (FIG. 7), this gives a V-shaped or triangular design of the leg 12. The cutout 17 is arranged above the mounting flange 14. The transition 18 between the holding portion 11 and the leg 12 is rounded with a radius. At the free end 13 of the leg 12, the latter transforms—also rounded with a radius—into the outwardly angled mounting flange 14.

The holding portion 11 of a metal bracket 9 has a length L measured in the longitudinal direction LR of the base body 6. Said length is greater than the outer cross-section Q of the base body 6. As evident in the depictions of FIGS. 1 and 2, a mounting support 8 is arranged between two injector receivers 4, 5 in the respective end region of the base body 6. The holding portions 11 have a length L in the longitudinal direction LR which covers at least 50% of the free distance A between the injector receivers 4, 5. The holding portions 11 may be made as wide as the installation space between the injector receivers 4, 5 and/or a pressure sensor connection 19 allows.

The metal brackets 9 of a mounting support, which are assigned to each other in pairs, are arranged directly diametrically opposite each other relative to the base body 6 of the pressure accumulator rail 2. In the exemplary embodiments shown, as evident in FIG. 2, the metal brackets are arranged axially offset to each other in the longitudinal direction on opposing long sides 20, 21 of the base body 6.

Produced by sheet-metal forming, the mounting supports 8 are configured as metal brackets 9 in the form of sheet-metal formed parts. This leads to a weight reduction of the fuel distributor 1. Furthermore, with this design, material-removal machining processes on the base body 6 are reduced or omitted. The fuel distributor 1 can bear high static and dynamic loads. This is guaranteed by the substance-bonded joint between the base body 6 and the mounting support 8, and the joint in the surrounding region of the metal brackets 9. Furthermore, the substance-bonded joint between the legs 12 of the metal brackets 9 increases the strength at the mounting points.

The substance-bonded joints are created by a soldering process. For this, solder or solder paste is applied as required, and the soldering process is carried out with heat treatment in a temperature range between 850° C. to 1100° C. The heat treatment in the soldering process soft-anneals the pressure accumulator rail 2, which improves the mechanical machining and guarantees a lower tool wear. The heat treatment leads to a recrystalline material structure. The soldering process and heat treatment with subsequent cooling allows the omission of any pickling and passivation process. The corrosion resistance of the fuel distributor 1 is increased.

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A fuel distributor, comprising:

a pressure accumulator rail for receiving pressurized fuel;

a forged base body having integral injector receivers; and a mounting support for mounting the pressure accumulator rail, the mounting support having two sheet-metal brackets, wherein each of the sheet-metal brackets comprises:

a holding portion adapted to an outer contour of the forged base body, a leg angled relative to the holding portion, and a mounting flange at a free end of the leg and angled away therefrom, the holding portions are configured to receive a length of the forged base body therebetween, the holding portions partially surround the forged base body, the forged base body and the holding portions are joined by substance bonding, and portions of the legs of the sheet-metal brackets which lie next to each other are joined together by substance bonding.

2. The fuel distributor according to claim 1, wherein each of the holding portions surrounds the forged base body in cross-section over a peripheral region, wherein the peripheral region extends over an angle of between 90° and 180°.

3. The fuel distributor according to claim 2, wherein the peripheral region is an arcuate portion in which the holding portion and the forged base body are in mutual contact.

4. The fuel distributor according to claim 1, wherein the legs are arranged below the forged base body and extend substantially rectilinearly.

5. The fuel distributor according to claim 1, wherein at least one of the sheet-metal brackets has a slot cutout in a longitudinal direction.

6. The fuel distributor according to claim 1, wherein at least one of the mounting flanges has a mounting opening.

7. The fuel distributor according to claim 1, wherein at least one of the legs tapers, starting from a transition to the holding portion towards the mounting flange.

8. The fuel distributor according to claim 1, wherein at least one of the holding portions has a length, measured in a longitudinal direction of the forged base body, which is greater than the cross-section of the forged base body.

9. The fuel distributor according to claim 1, wherein the mounting support is arranged between two adjacent injector receivers among the injector receivers.

10. The fuel distributor according to claim 1, wherein at least one of the holding portions has a length measured in the longitudinal direction of the forged base body such that the holding portion covers at least 50% of the distance between two adjacent injector receivers among the injector receivers.

11. The fuel distributor according to claim 1, wherein at least one of the sheet-metal brackets has an S-shaped contour in a vertical cross-section.

12. The fuel distributor according to claim 1, wherein the sheet-metal brackets are identical to each other.

13. The fuel distributor according to claim 1, wherein each of the holding portions surrounds the forged base body in cross-section over a peripheral region, wherein the peripheral region extends over an angle of between 100° and 160°.

14. The fuel distributor according to claim 1, wherein each of the holding portions surrounds the forged base body in cross-section over a peripheral region, wherein the peripheral region extends over an angle of between 110° and 140°.

15. The fuel distributor according to claim 1, wherein each of the holding portions surrounds the forged base body in cross-section over a peripheral region, wherein the peripheral region extends over an angle of between 130°±5°.

* * * * *